US009496059B2

(12) United States Patent
Tran

(10) Patent No.: US 9,496,059 B2
(45) Date of Patent: Nov. 15, 2016

(54) METHOD FOR STORING RADIOCONTAMINATED WASTE MATTER AND CONTAINER THEREFOR

(71) Applicant: SAN-EI REGULATOR CO., LTD., Fujinomiya-shi, Shizuoka (JP)

(72) Inventor: Ai Van Tran, Fujinomiya (JP)

(73) Assignee: CORELEX SAN-EI CO., LTD., Fujinomiya-shi, Shizuoka (JP)

( * ) Notice: Subject to any disclaimer, the term of this patent is extended or adjusted under 35 U.S.C. 154(b) by 198 days.

(21) Appl. No.: 14/707,693

(22) Filed: May 8, 2015

(65) Prior Publication Data

US 2015/0325320 A1 Nov. 12, 2015

(30) Foreign Application Priority Data

May 12, 2014 (JP) ..... 2014-098671

(51) Int. Cl.
*G21F 9/06* (2006.01)
*G21F 5/005* (2006.01)
*G21F 1/04* (2006.01)

(52) U.S. Cl.
CPC ..... *G21F 5/005* (2013.01); *G21F 1/045* (2013.01)

(58) Field of Classification Search
CPC ..... G21F 9/06
USPC ..... 588/4
See application file for complete search history.

(56) References Cited

FOREIGN PATENT DOCUMENTS

| | | | |
|---|---|---|---|
| JP | 60-41000 | A | 3/1985 |
| JP | 2007-51908 | A | 3/2007 |
| JP | 2013-068459 | A | 4/2013 |
| JP | 2013-130403 | A | 7/2013 |
| JP | 2013-134226 | A | 7/2013 |
| JP | 2013-195416 | A | 9/2013 |
| JP | 2013-210342 | A | 10/2013 |
| JP | 2014-44201 | A | 3/2014 |
| JP | 2014-55806 | A | 3/2014 |

*Primary Examiner* — Edward Johnson
(74) *Attorney, Agent, or Firm* — Sughrue Mion, PLLC

(57) ABSTRACT

A method for securely and safely storing radiocontaminated waste matter and a container therefor are provided. Radiocontaminated waste matter and PSC are mixed and then retained and stored in a tetragonal cylindrical container tank 1 made of steel sheet, concrete, or PSC-containing concrete, so that the spatial gamma radiation dosage of the environment around the tank 1 becomes about the same as that of an environment or place which receives no fall-out radioactive substances. When a mixture of radiocontaminated waste matter and PSC is ashed, and the ash thus obtained is again mixed with PSC, and then loaded and stored in said container tank, the spatial gamma radiation dosage around said container tank is to be similar to that of an environment or place which receives no fall-out radioactive substances, and simultaneously both $^{134}Cs$ and $^{137}Cs$ are decreased, and as a result radiocontaminated waste matter can be securely and safely loaded and stored for a long-period of time.

17 Claims, 2 Drawing Sheets

METHOD FOR STORING RADIOCONTAMINATED WASTE MATTER AND CONTAINER THEREFOR

BACKGROUND OF THE INVENTION

1. Field of the Invention

The present invention relates to a method for safely and securely storing radiocontaminated wastes, such as soil, sludge generated from treatment of waste water and sewage, boiler ashes, rubbles from manmade and/or natural disasters, farmed and/or forest mushrooms, and leaves and also relates to the container for the above method.

2. Description of the Related Art

According to the U.S. classification system, nuclear waste is classified into high-level waste (HLW), transuranic (TRU) waste, uranium mill tailings, and low-level waste (LLW). Generally, not less than 99% of the total radioactivity in nuclear waste is contained in HLW, while LLW takes up the biggest share, about 85% or more of the entire weight of nuclear waste generated. Of the above, soil, sludge, boiler ashes, rubbles, forest mushrooms, fallen leaves, and the like (hereinafter referred to as "radiocontaminated waste matter") are belonged to LLW.

The general practice for decontaminating radiocontaminated agricultural lands, roads, school lands, and the like resulted from a nuclear accident is to remove the contaminated surface soil and for private houses and public buildings is to wash their roofs using jet water. The said removed radiocontaminated waste matter is then shielded by storing in, for example, flexible container bags, sandbags or the like and then isolated.

The Japanese Environment Ministry has proposed temporary storage sites for smoothly storing and managing a large amount of radiocontaminated waste matter (Patent document 1). In those temporary storage sites, flexible container bags, sandbags, and the like, each filled with radiocontaminated waste matter, are stacked on a water-barrier sheet laid on the ground. These flexible container bags, sandbags are, in turn, shielded by placing filling soil and sandbags upon them.

However, since the said shielding filling soil and sandbags are susceptible to damage from rain, snow, earthquakes, and other causes, and because the radiocontaminated wastes-containing flexible container bags and sandbags have low densities and thickness, moisture from the surrounding ground may permeate the water-barrier sheet, and hence, radiocontaminated waste matter may, in turn, contaminate the surrounding environment (air, groundwater, and the like) of the temporary storage site.

In order to improve the temporary storage site of the type described above, storage facilities for radiocontaminated materials disclosed in the Patent document 1 have been proposed as alternative facilities. In the proposed storage facilities, radiocontaminated materials are shielded by a dome-shaped structure made of corrugated steel sheets and buried in healthy soil. For these storage facilities, the thickness of the corrugated steel sheet is 0.6 cm and the shallowest depth of the healthy soil 30 cm. It is calculated that these values allow the radiation dosage to be reduced by 90%. In this calculation, the half value layers (HVL) of iron and soil are assumed to be 1.5 cm and 5 cm, respectively, and these HVL's are applied only to $^{137}Cs$. Since the radiation dosage from radiocontaminated materials is due to $^{134}Cs$, $^{137}Cs$, $^{60}Co$, and the like in the gamma ray, the accuracy of the said calculation remains uncertain.

In a storage structure for shielding radioactive substances-containing materials disclosed in the Patent document 2, bags filled with contaminated soil are placed on a bottom water barrier layer (sheet), and a radiation shielding wall structure is constructed composed of stacked sandbags or retaining walls around its periphery. The topmost surfaces of the bags are covered with a covering body made of a radioactive cesium absorbing powder containing one or more of zeolite, lead, tungsten, barium sulfate, and the like, and a resin or a rubber blended therewith. In order to keep out water, the storage structure is covered with a tent roof. However, the shielding effect of the covering body of this storage structure against gamma rays and the specifications thereof are not disclosed.

In both the storage facilities for radiocontaminated materials (Patent document 1) and the storage structure for radioactive substances-containing materials (Patent document 2), radiocontaminated soil is filled into a flexible container bag and/or a sandbag, neither of which can be shielded against gamma rays. However, in a radiation shielding building disclosed in the following Patent document 3, a mixture of highly functional ceramic concrete and construction materials (such as wood, iron, and concrete) is used without incorporating ordinary lead, lead alloy, antimony-containing material, or the like. In one embodiment, when radiocontaminated soil was filled into a first box made of a highly functional ceramic concrete having a thickness of 5 cm, the radiation dose decreased from 147 μSv/h to 7.5 μSv/h, and a shielding rate of 94.9% was obtained, corresponding to a half value layer of 1.165 cm of the highly functional ceramic concrete. When a second box made of a highly functional ceramic concrete having a thickness of 5 cm was provided around the first box, the radiation dose further decreased from 7.5 μSv/h to 2.0 μSv/h, and a shielding rate of 73.3% was obtained, corresponding to a half value layer of 2.622 cm. Furthermore, when a third box made of a highly functional ceramic concrete having a thickness of 10 cm was provided around the second box, the radiation dose decreased from 2 μSv/h to 0.9 μSv/h, and a shielding rate of 55% was obtained, corresponding to a half value layer of 8.681 cm. The final radiation dose of 0.9 μSv/h is still higher than the 0.065 to 0.072 μSv/h radiation dosage in Fujinomiya city, Shizuoka prefecture, at a straight-line distance of approximately 330 km from the earthquake- and tsunami-damaged nuclear power plant in Fukushima Prefecture. Since the half value layer of the highly functional ceramic concrete changed with varied radiation dosages, it seems likely that the density was uneven and/or the shielding efficiency decreased at low radiation dosages. The following equation 1 was used to calculate the half value layer (Patent document 1).

$$1-\text{Shielding rate}=1/\left[e^{(\text{thickness of shielding structure}\div\text{half value layer of shielding structure}\times\ln 2)}\right] \quad \text{[Equation 1]}$$

Additionally, a radiation shielding material disclosed in the Patent document 4 is made by granulating or molding a water slurry containing magnesium oxide and debris of a lead-containing glass, such as discarded cathode-ray tube glass, followed by drying. Although lead-containing glass can be formed as a plate having a thickness of 1 to 10 cm, the performance (half value layer), density, Mohs hardness, and the like thereof are not disclosed.

This applicant carried out a decontamination field test for a radiocontaminated rice paddy using a paper sludge-derived sintered carbonized porous grains and obtained the results indicating that radioactive substances could be removed from radiocontaminated agricultural soil by this method.

Furthermore, it was found that the polished rice harvested from the improved soil contained a total of 30 Bq/kg of $^{134}$Csc and $^{137}$Cs, which is lower than the new Japanese standard limits of 100 Bq/kg for radiocesium in foods. Details are disclosed in the Patent document 5 below.

The said paper sludge-derived sintered carbonized porous grains are formed by sintering and carbonization of paper sludge discharged from paper manufacturing mills which use either waste paper or wood chip or both waste paper and wood chip and the composition thereof is as described below.

(1) Paper sludge discharged from paper manufacturing mills which use either waste paper or wood chip or both waste paper and wood chip is processed by sintering/carbonization to form a paper sludge-derived sintered carbonized porous grains which have a pH of 8 or more and preferably 10 or more; an alkalinity equivalent value of 1.0 to 4.0 meq/g (as NaOH) and preferably 1.5 to 2.5 meq/g (as NaOH); a cation exchange capacity of 1.0 to 4.0 meq/100 g (as $NH_4^+$) and preferably 1.5 to 3.0 meq/100 g (as $NH_4^+$); an electric conductivity of 70 to 150 μS/cm; a sodium content of 0.0003% or more; and a potassium content of 0.0003% or more, and the paper sludge-derived sintered carbonized porous grains thus obtained is dispersed on or mixed with radiocontaminated soil to remove radioactive substances therefrom.

(2) In the manufacturing process of the said paper sludge-derived sintered carbonized porous grains, the impregnation of the paper sludge with either potassium iodide (KI) alone or ethylenediaminetetraacetic acid (EDTA) alone or a combination of KI and EDTA was not incorporated.

(3) The radiocontaminated soil contains radioactive $^{134}$Cs and $^{137}$Cs at a total dosage of 800 Bq/kg or above.

(4) The dosage of the said paper sludge-derived sintered carbonized porous grains spread on or mixed with the radiocontaminated soil is 0.1 to 6 kg/m$^2$ (0.5 to 50 kg/m$^3$) (0.1 to 6 percent by weight of dry soil) and preferably 1.0 to 3.5 kg/m$^2$ (8 to 30 kg/m$^3$) (0.9 to 3.3 percent by weight of dry soil).

(5) The paper sludge has a moisture content of 50% to 85%, and after being pelletized and dried, this paper sludge is pyrolyzed in a reducing carbonization sintering furnace at a temperature of 500° C. to 1,300° C., preferably 700° C. to 1,200° C. Furthermore, carbonization is preferably carried out at 800° C. to 1,100° C.

(6) The said paper sludge-derived sintered carbonized porous grains contain, on oven-dry weight basis, 15% to 25% of combustibles (including carbon), 0.5% to 3.0% of $TiO_2$, 0.0001% to 0.0005% of $Na_2O$, 0.0001% to 0.0005% of $K_2O$, 15% to 35% of $SiO_2$, 8% to 20% of $Al_2O_3$, 5% to 15% of $Fe_2O_3$, 15% to 30% of CaO, 1% to 8% of MgO, and a balance of 0.5% to 3.0% (including impurities), the total of these being 100%; and has a water absorption rate of 100% to 160% in accordance with JIS C2141, a specific surface area of 80 to 150 m$^2$/g in accordance with the BET adsorption method, and an interconnected cell structure.

(7) The said paper sludge-derived sintered carbonized porous grains are to have a porosity volume of not less than 70%, a porosity volume of not less than 1,000 mm$^3$/g, an average pore radius of 20 to 60 μm, and pores with radius of not less than 1 μm constitute not less than 70% of the total porosity volume, and are a mixture of various forms such as spherical, oval, or cylindrical or the like forms with each having an axis length of 1 to 10 mm, and a black color.

PRIOR ART DOCUMENTS

Patent Documents

Patent document 1: Japanese Unexamined Patent Application Publication No. 2013-134226

Patent document 2: Japanese Unexamined Patent Application Publication No. 2013-130403

Patent document 3: Japanese Unexamined Patent Application Publication No. 2013-195416

Patent document 4: Japanese Unexamined Patent Application Publication No. 2013-210342

Patent document 5: Japanese Unexamined Patent Application Publication No. 2013-068459

As described above, because treatment facilities for radiocontaminated waste matter are not established yet, the most suitable decontamination methods for radioactive substances are currently not available.

In Fukushima prefecture, where radioactive substances from the Nuclear Power Plant disaster on Mar. 11, 2011, are detected in some soil areas, the amount of radiocontaminated waste matter is at least 250,000 ton, which, in turn, is bagged into one tone-sized blue vinyl bags. These bags are piled on each other and stored atop manmade plateaus built on nearby mountains and around people's homes and rice fields. There are currently 30 of such locations around the prefecture. The blue bags are temporary and designed to withstand the environment for 5 years. (www.foreignpolicy.com/articles/2014/02/20/250000_tons_of_radioactive_soil_in_fukushima_japan). Additionally, the blue bags can only partially shield the gamma radiation from the inside radiocontaminated waste matter and their usable life is limited. The said temporary manmade plateaus are therefore liable to be contaminated by the radiocontaminated waste matter.

The objective of the present invention is to provide a method for shielding radiocontaminated waste matter and a container therefor. Specifically, the invented method would comprehensively satisfy the requirements of cost, practicality, safety, and security, and that it would shield gamma radiation emitted from radiocontaminated waste matter, as well as it can make the spatial radiation dosage at the storage site similar to that of a place at a straight-line distance of 330 km from the Fukushima Nuclear Power Plant where the nuclear disaster took place. In the present invention, it is assumed that the location of the present applicant at a straight-line distance 330 km from the abovementioned Nuclear Power Station is a place (hereinafter referred to as a "blank spatial radiation dosage") not influenced by the gamma radiation emitted by the Fukushima Daiichi Nuclear Power Plant disaster.

SUMMARY OF THE INVENTION

The method and the container for shielding radiocontaminated waste matter according to the present invention can comprehensively satisfy requirements for cost, practicality, safety, and security, can shield the gamma radiation from radiocontaminated waste matter, and can also make the spatial radiation dosage at the storage site similar to that of a place at a straight-line distance of 330 km from the Fukushima Daiichi Nuclear Power Plant where the nuclear disaster occurred. In order to temporarily or permanently store radiocontaminated waste matter, building a tank is advantageous in terms of cost, location, and practicality.

According to the method and the container for shielding radiocontaminated waste matter of the present invention, when radiocontaminated waste matter is partially replaced with the said paper sludge-derived sintered carbonized porous grains or potassium chloride-impregnated paper sludge-derived sintered carbonized porous grains, the spatial gamma radiation dosage around a receiving or storage tank would be similar to the blank spatial gamma radiation dosage, and thus the advantage of the present invention is that the safety and security for the environment and health can be maintained.

When radiocontaminated waste matter alone or a mixture of it with the said paper sludge-derived sintered carbonized porous grains are ashed, and the ashes thus obtained are mixed again with the said paper sludge-derived sintered carbonized porous grains, the weight, volume, and radioactive $^{134}Cs$ and $^{137}Cs$ are all decreased, and the gamma radiation level around the storage site is equal to the blank spatial gamma radiation dosage; therefore, a large amount of radiocontaminated waste matter and paper sludge-derived sintered carbonized porous grains can be charged into a container/tank made of, for example, steel sheet, concrete, or concrete containing paper sludge-derived sintered carbonized porous grains, without causing any problem regarding spatial gamma radiation dosage in the environment around the container/tank and as such its long-term retention and storage can be done safely and securely.

DESCRIPTION OF THE PREFERRED EMBODIMENTS

Figure 1:
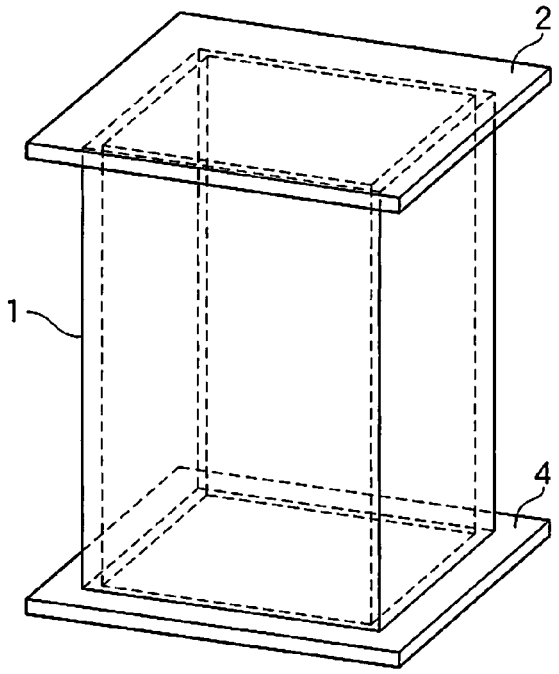
FIG. 1 is a schematic perspective view of a container/tank used for the method of shielding radiocontaminated waste matter according to an embodiment of the present invention.
Figure 2:
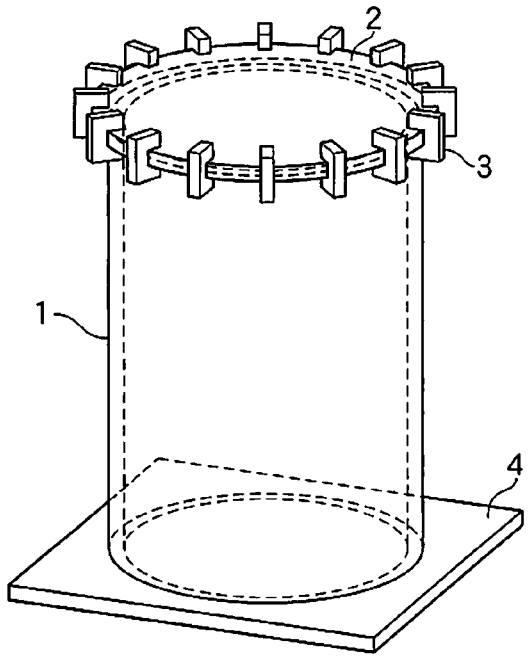
FIG. 2 is a schematic perspective view of a container used for the method of shielding radiocontaminated waste matter according to an embodiment of the present invention.
Figure 3:
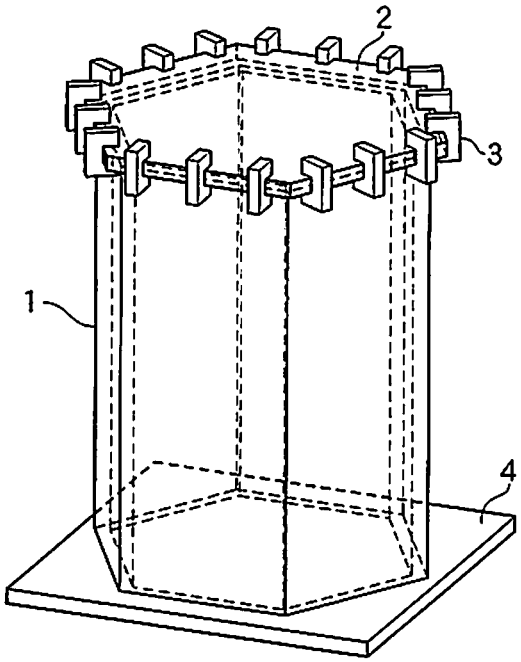
FIG. 3 is a schematic perspective view of a container used for the method of shielding radiocontaminated waste matter according to an embodiment of the present invention.

Hereinafter, embodiments of the present invention will be described. However, the present invention is not limited to the following embodiments.

In the method of shielding radiocontaminated waste matter according to an embodiment of the present invention, paper sludge-derived sintered carbonized porous grains (hereinafter referred to as PSC)) are mixed with radiocontaminated waste matter, and the mixture thus obtained is charged into and stored in a tank 1 functioning as a container. The tank 1 has a lid 2 and a bottom base plate 4, and the materials of the tank 1, the lid 2 and the bottom base plate 4 are the same.

According to the Occupational Safety and Health Administration of the U.S. Department of Labor, radioactive isotopes $^{37}Cs$ and $^{60}Co$ have adverse effect on human health. The present invention examined the efficacy of iron (density: 7.86 g/cm$^3$) and concrete (density: 2.35 g/cm$^3$) in shielding $^{60}Co$ and $^{137}Cs$. The half value layers of both iron and concrete in shielding $^{60}Co$ are 20 mm and 61 mm, respectively (International Commission on Radiological Protection, ICRP Pub. 21). These values are higher than those of iron (1.5 cm) and concrete (4.9 cm) in shielding $^{137}Cs$. Compared to $^{60}Co$, $^{137}Cs$ has a longer half-life (30.17 years vs. 5.27 years) and a lower energy (0.6616 MeV vs. 1.3325 MeV). Therefore, the half value layer of a material for gamma radiation shielding depends on the density of the material and the energy rather than on the half-life of the radioisotopes to be shielded.

The tank 1 does not require a retaining wall structure. The tank 1 in which radiocontaminated waste matter is to be filled is made of steel sheet, concrete or other material that shields gamma radiation emitted from radiocontaminated waste matter, and is set up with the bottom base plate 4 resting on the ground. The tank 1 is, for example, made in the shape of a regular polygonal cylinder having at least four corners or a circular cylinder in accordance with the shape of the packaged radiocontaminated waste matter. In order to cope with cases in which a large amount of radiocontaminated waste matter is stored, the volume of the tank 1 is required to be at least 1,000 m$^3$. As such a tank farm would be formed.

When the shape of the tank 1 is circular cylindrical, its diameter must be equal to its height so that its volume would be maximum. In this case, the correlation between the tank volume (y) and the tank diameter (x) is expressed by $y=0.7854x^3$ ($R^2=1$) (Equation 2), and when the tank volume is 1,000 m$^3$, both the tank diameter and height would be 10.838513 m.

When circular cylindrical vinyl bags (diameter=height=1.0838513 m) each with 1 m$^3$ volume to hold one ton of radiocontaminated waste matter are loaded in a circular cylindrical storage tank with a volume of 1,000 m$^3$, the filling rate is only 78.5% because even though the cylindrical vinyl bag has a circular shape it would occupy a square area. The tank 1 therefore preferably has a cubic shape (10 m×10 m×10 m). Accordingly, the diameter of the cubic tank 1 is smaller than that of the tank 1 of circular cylindrical shape, and when a square vinyl bag having a volume of 1 m$^3$ is used, the filling rate of the tank 1 would be approximately 100%. In order to improve the filling rate when a circular cylindrical storage tank with a volume of 1,000 m$^3$ is used, radiocontaminated waste matter is loaded directly into the storage tank in bulk without using a circular cylindrical or square vinyl bag of 1 m$^3$ volume.

When steel sheet is used as the material of the tank 1, a thickness of approximately 10 to 15 mm and a density of approximately 7.0 to 7.8 g/cm$^3$ are preferable; when concrete without PSC is used, a thickness of approximately 60 to 65 mm, and a density of approximately 2.0 to 2.4 g/cm$^3$ are preferable; and when PSC-containing concrete PSC is employed, a thickness of approximately 60 to 65 mm and a density of approximately 1.8 to 2.4 g/cm$^3$ are preferable.

When the material of the tank 1 is steel sheet, the lid 2 and the bottom base plate 4 of the tank 1 are preferably made of material similar to that of the tank 1 and of about the same thickness. When the material of the tank 1 is concrete, and the lid 2 and the bottom base plate 4 are also made from concrete, their thicknesses are made substantially equal to that of the tank 1. On the other hand, when the material of the tank 1 is concrete, and the lid 2 and the bottom base plate 4 are made from steel sheet, their thicknesses are made about equal, in the range of approximately 10 to 15 mm.

The concrete is composed of cement, sand and gravel, and 15% to 35% of the gravel content can be replaced with PSC. The spatial gamma radiation dosage around the tank 1 made of concrete containing PSC becomes similar to the blank spatial gamma radiation dosage.

When 20% (by weight) of radiocontaminated waste matter is replaced with PSC, followed by mixing, and the resulting mixture is loaded into the tank 1, the spatial gamma radiation dosage around the tank 1 becomes similar to the blank spatial gamma radiation dosage.

As the decontamination of radioactive wastes contaminated by $^{134}Cs$ and $^{137}Cs$ is concerned, the decontamination degree of the PSC with impregnated potassium chloride is approximately two times higher than that of the PSC without impregnated potassium chloride. Thus, the mixing ratio of PSC with radiocontaminated waste matter can be decreased from 20% to 10%. Accordingly, the loading rate of radiocontaminated waste matter into the tank 1 will be increased. When radiocontaminated waste matter and/or a mixture of radiocontaminated waste matter and PSC which replaces 20% thereof is ashed, and PSC in an amount corresponding to 20% of this ash is added thereto and then mixed therewith to form an ash mixture, the gamma radiation dosage of this ash mixture is similar to that of the blank spatial gamma radiation, and radioactive $^{134}Cs$ and $^{137}Cs$ are also decreased. As a result, this ash mixture can be safely and securely loaded and stored in the tank 1.

More specifically, when radiocontaminated waste matter and a mixture of radiocontaminated waste matter and PSC which replaces 20% thereof are each ashed at a temperature of 850° C. for 90 minutes, the weight of the radiocontaminated waste matter and that of the mixture of the radiocontaminated waste matter and PSC which replaces 20% thereof are each decreased by 10% to 15%. Thus, it is expected that the volume thereof can also be decreased by about the same percentage. Since ashing lowers the gamma radiation dosage of radiocontaminated waste matter to a value close to the blank spatial gamma radiation dosage, it is estimated that a large amount of ashes can be loaded into the tank 1, and that the spatial gamma radiation dosage around the tank 1 is to be about the same as the blank spatial gamma radiation dosage of 0.065 to 0.072 μSv/h.

When radiocontaminated waste matter or a mixture of radiocontaminated waste matter and PSC which replaces 20% thereof is ashed, and PSC in an amount corresponding to 20% of this ash thus obtained is again added thereto and mixed therewith, the weight, volume, and radioactive $^{134}Cs$ and $^{137}Cs$ of the obtained ash mixture are all decreased, and the surrounding gamma radiation dosage becomes similar to the blank spatial gamma radiation dosage. Hence, the filling rate of the obtained ashes in the tank 1 would be improved, the spatial gamma radiation dosage in the surrounding environment of the tank 1 would not cause any problem, and a safe and secure long-term retention and storage is thus possible.

DETAILED DESCRIPTION OF EMBODIMENTS

Below are the examples of the present invention.

In order to confirm the shielding efficiency of radiocontaminated waste matter by a tank made of steel sheet and a tank made of concrete, a rectangular steel sheet tank, a rectangular concrete tank, and a rectangular concrete tank in which 15% of gravel was replaced with PSC were constructed, and the shielding tests were performed. As the sample of radiocontaminated waste matter, radiocontaminated soil from a paddy in Iitate village, Fukushima prefecture was collected at the beginning of September 2013 (soil in some areas of Fukushima prefecture contained radioactive matters because of the Nuclear Power Plant disaster on Mar. 11, 2011). The gamma radiation dosage was measured using a Hitachi-Aloka pocket survey meter PDR-111. $^{134}Cs$ and $^{137}Cs$ were determined using a Canberra coaxial germanium detector in accordance with "the manual for radiation measurement of foods in emergencies" issued by the Japanese Ministry of Health, Labor and Welfare and "Gamma-ray spectrometry with germanium semiconductor detectors", issued by the Japanese Ministry of Education, Culture, Sports, Science and Technology. The gamma radiation dosage of the radiocontaminated paddy soil was 1.763 μSv/h, and the total of $^{134}Cs$ and $^{137}Cs$ thereof was 26,914 Bq/kg (30,277 Bq/kg oven-dry weight).

Reference Example 1

The steel sheet tank was a cold rolled square steel pipe for construction purposes (BCR). It had a thickness of 6.05 mm, an inside width of 8.78 cm, a height of 30.11 cm, and a density of 7.10 g/cm$^3$. The lid and the bottom base plate were steel sheets having a width of 22.9 cm and a thickness of 8.90 mm. After the steel sheet tank was fixed on the bottom base plate, 1,310 g oven-dry weight (1,853.6 g air-dried weight) of the radiocontaminated paddy soil was loaded into the tank. The tank was covered with the lid and left to stand. The gamma radiation dosage was measured on the lid and on the ground side of the bottom base plate for five minutes per measurement. On Day 15, an outside steel sheet tank, namely, a cold rolled rectangular steel pipe having a thickness of 8.01 mm, an inside width of 18.35 cm, a height of 30.11 cm, and a density of 7.18 g/cm$^3$, was installed to enclose the first-mentioned steel sheet tank. PSC was charged into the 4.18 cm space between the outside and the inside steel sheet tanks, and the tanks were again covered with the lid and left to stand. Subsequently, the gamma radiation dosage was measured.

TABLE 1

<Shielding Efficiency of a Radiocontaminated Paddy Soil by a Rectangular Steel Pipe>

| | Spatial Gamma Radiation Dosage (μSv/h) | | | |
|---|---|---|---|---|
| | On Upper Lid | | Ground at Bottom Base | |
| Day | Mean | σ | Mean | σ |
| Day 1 | 0.104 | 0.010 | 0.111 | 0.012 |
| Day 8 | 0.097 | 0.013 | 0.104 | 0.009 |
| Day 15 | 0.097 | 0.014 | 0.099 | 0.005 |
| Day 22 * | 0.097 | 0.009 | 0.095 | 0.011 |
| Day 29 * | 0.095 | 0.008 | 0.090 | 0.010 |

* After PSC was charged in the space between the outside and inside rectangular steel pipes.

As shown in Table 1, the gamma radiation dosage decreased from an initial value of 1.763 μSv/h to 0.097 μSv/h measured on Day 15, and a shielding rate of 94.5% was obtained. The last two gamma radiation dosage measurements were made after installing the outside steel sheet tank and charging the PSC. The final value (0.090 to 0.095 μSv/h) was slightly higher than the blank spatial gamma radiation dosage of 0.065 to 0.072 μSv/h.

Example 1

In a test in which 20% of the radiocontaminated paddy soil was replaced with PSC, a mixture of the radiocontaminated paddy soil (1,048 g oven-dry weight, 1,482.9 g air-dried weight) and PSC (262 g oven-dry weight, 266.6 g air-dried weight) was loaded into the same steel sheet tank of Reference Example 1, and the experiment was performed in accordance with the method described in Reference Example 1 but without the outside steel sheet tank. Compared to the mixture of the radiocontaminated paddy soil and PSC, the spatial gamma radiation dosage of the original radiocontaminated paddy soil was decreased by 72.1% from the initial value of 1.763 μSv/h to 0.491 μSv/h, and the total of $^{134}Cs$ and $^{137}Cs$ decreased by 27.9%, that is, from 30,227 Bq/kg oven-dry weight to 21,788 Bq/kg oven-dry weight. These results suggest that there were other components in the gamma-ray that were easier to be shielded under the presence of PSC than $^{134}Cs$ and $^{137}Cs$. In this example, the oven-dry weight is the weight obtained when the moisture content of the paddy soil is 0%, i.e. the paddy soil is dried at 105° C. until the weight thereof is constant.

TABLE 2

<Shielding Efficiency of a Mixture of Radiocontaminated Paddy Soil and PSC by a Rectangular Steel Pipe>

| | Spatial Gamma Radiation Dosage (μSv/h) | | | |
|---|---|---|---|---|
| | On Upper Lid | | Ground at Bottom Base | |
| Day | Mean | σ | Mean | σ |
| Day 1 | 0.101 | 0.006 | 0.087 | 0.006 |
| Day 2 | 0.103 | 0.008 | 0.085 | 0.008 |
| Day 8 | 0.096 | 0.006 | 0.084 | 0.007 |
| Day 21 | 0.080 | 0.010 | 0.080 | 0.005 |
| Day 28 | 0.078 | 0.008 | 0.080 | 0.006 |

A comparison of Tables 1 and 2 shows that the spatial gamma radiation dosage on Day 1 of the mixture of radiocontaminated paddy soil and PSC (Table 2) was slightly lower than that of the radiocontaminated paddy soil alone (Table 1), and that the value on Day 28 was approximately equal to the blank spatial gamma radiation dosage of 0.065 to 0.072 μSv/h. It is believed that this is due to the ion exchange between PSC and radioactive substance in the radiocontaminated paddy soil.

Reference Example 2

The tank made of PSC-containing concrete was constructed from cement, sand, gravel, and PSC without using any reinforcing steel, and the mixing rate was 12% of cement, 24% of sand, 51% of gravel, and 20.3% of PSC with respect to the gravel. The main body, the lid, and the bottom base plate of the concrete tank were made of the same raw materials and mixing ratios. The specifications of the tank made of PSC-containing concrete were: a thickness of 61.02 mm, an inside width of 86.65 mm, a height of 30.56 cm, and a density of 1.817 g/cm$^3$. The specifications of the lid were: a width of 34.85 cm and a thickness of 32.28 mm. The specifications of the bottom base plate were: a width of 40.5 cm and a thickness of 32.73 mm. The tank made of PSC-containing concrete was used to carry out the same shielding test as that performed with the steel sheet tank. The concrete tank was enclosed by an outside concrete tank on Day 25, and the shielding test was continued afterward. Of the outside concrete tank, the raw materials and their mixing ratios were similar to those of the inside concrete tank but the thickness was 61.94 mm, the outside width 34.52 cm, and the height 30.55 cm. The space between the outside and inside concrete tanks was approximately 12 mm.

TABLE 3

<Shielding Efficiency of Radiocontaminated Paddy Soil by PSC-containing Concrete Rectangular Tank>

| | Spatial Gamma Radiation Dosage (μSv/h) | | | |
|---|---|---|---|---|
| | On Upper Lid | | Ground at Bottom Base | |
| Day | Mean | σ | Mean | σ |
| Day 1 | 0.104 | 0.010 | 0.115 | 0.012 |
| Day 10 | 0.101 | 0.011 | 0.104 | 0.009 |
| Day 25 | 0.097 | 0.010 | 0.099 | 0.005 |
| Day 40 * | 0.090 | 0.010 | 0.095 | 0.011 |
| Day 51 * | 0.090 | 0.017 | 0.090 | 0.010 |

* After the inside rectangular tank was enclosed by the outside rectangular tank.

The shielding test was carried out for 51 days using a double shielding structure composed of the outside and inside concrete tanks. The final value (0.090 μSv/h) of the spatial gamma-ray dosage was slightly higher than the blank spatial gamma radiation dosage of 0.065 to 0.072 μSv/h (Table 3) and was substantially the same as the result of the shielding test using the steel sheet tank (Table 1). Hence, a test for confirming the effect of the addition of PSC to the radioactively contaminated paddy soil was performed.

Example 2

Similar to the shielding test using the steel sheet tank, a mixture of the radiocontaminated paddy soil and PSC at a oven-dry weight ratio of 4:1 was loaded into an inside concrete tank, and the test was performed according to the method of Reference Example 2 but without the outside concrete tank. As in the case of Example 1 of the steel sheet tank, the value on Day 51 was almost equivalent to the blank spatial gamma radiation dosage of 0.065 to 0.072 μSv/h. The results are shown in Table 4.

TABLE 4

<Shielding Efficiency of Mixture of Radiocontaminated Paddy Soil and PSC by PSC-containing Concrete Rectangular Tank>

| | Spatial Gamma Radiation Dosage (μSv/h) | | | |
|---|---|---|---|---|
| | On Upper Lid | | Ground at Bottom Base | |
| Day | Average | σ | Average | σ |
| Day 1 | 0.097 | 0.010 | 0.110 | 0.012 |
| Day 8 | 0.090 | 0.010 | 0.104 | 0.010 |
| Day 20 | 0.083 | 0.009 | 0.092 | 0.008 |
| Day 36 | 0.080 | 0.010 | 0.084 | 0.011 |
| Day 51 | 0.077 | 0.007 | 0.080 | 0.008 |

Example 3

In order to improve the filling rate of the radiocontaminated paddy soil in the storage tank, the said paddy soil was ashed in an electric furnace at 850° C. for 90 minutes. The ash contents of the radiocontaminated paddy soil alone and the mixture of PSC and radiocontaminated paddy soil were 89.67% and 86.03%, respectively. Thus, the ashing lowered the weight of the radiocontaminated paddy soil by 10% to 15%, and it is expected that the volume thereof is also reduced by similar percentages. As indicated in Table 5 below, because the ashes of the radiocontaminated paddy soil alone and the mixture of PSC and radiocontaminated paddy soil showed spatial gamma radiation dosages close to the blank spatial gamma radiation dosage, it is believed that if the ashes were to be loaded and stored in a tank, such as a steel sheet tank, a concrete tank, or a PSC-containing concrete tank, the spatial gamma radiation dosage of the environment around the tank would be decreased to a value similar to the blank spatial gamma radiation dosage of 0.065 to 0.072 μSv/h.

Compared to the radiocontaminated paddy soil, the total of $^{134}$Cs and $^{137}$Cs of the mixture of PSC and the radiocontaminated paddy soil decreased by 27.9% (from 30,227 Bq/kg oven-dry weight to 21,788 Bq/kg oven-dry weight) as in the case of Reference Example 1. However, after the radiocontaminated paddy soil itself and the mixture of PSC and the radioactively contaminated paddy soil were ashed, the results for $^{134}$Cs and $^{137}$Cs were approximately the same as those for the samples before the ashing. Thus, the spatial gamma radiation dosage was decreased by ashing but no change in $^{134}$Cs and $^{137}$Cs was observed.

TABLE 5

<Effect of Ashing on Radiocontaminated Paddy Soil alone as well as Mixture of Radiocontaminated Paddy Soil and PSC>

| | | Constituents | |
|---|---|---|---|
| | | Radio-contaminated paddy soil alone | Mixture of radio-contaminated paddy soil and 20% PSC |
| Ash content (%) | Mean | 89.67 | 86.03 |
| | σ | 0.79 | 1.00 |
| Gamma ray radiation dosage (μSv/h) | | | |
| Contaminated paddy soil | Mean | 1.281 | 0.148 |
| | σ | 0.124 | 0.015 |
| Ash | Mean | 0.082 | 0.078 |
| | σ | 0.010 | 0.007 |
| Radiocesium (Bq/kg oven-dry weight) | | | |
| Contaminated paddy soil | $^{134}$Cs | 8,309 | 6,025 |
| | $^{137}$Cs | 21,918 | 15,763 |
| | Total | 30,227 | 21,788 |
| Ash | $^{134}$Cs | 8,233 | 6,573 |
| | $^{137}$Cs | 21,074 | 17,299 |
| | Total | 29,307 | 23,871 |

Example 4

Since the gamma ray radiation dosage of the ash in (11) Example 3 was slightly higher than the blank spatial gamma radiation dosage of 0.065 to 0.072 μSv/h, this ash was added with PSC in an amount corresponding to 20% thereof (percentage to the weight of the ash), followed by mixing. After the mixture had stood for 3 days, the gamma radiation dosage of the mixture of the ash and PSC was measured. As shown in Table 6, when PSC was added to the ash of the radiocontaminated paddy soil alone, there was no change in the gamma radiation dosage. However, when PSC was added to the ash of the mixture of PSC and radiocontaminated paddy soil, the gamma radiation dosage was approximately the same as the blank spatial gamma radiation dosage of 0.065 to 0.072 μSv/h. Hence, the suitable method to securely and safely retain and store radiocontaminated paddy soil is as follows. First, the radiocontaminated paddy soil is mixed with PSC and then ashed. The ash thus obtained is again mixed with PSC and then loaded and stored in a tank, such as a steel sheet tank, a concrete tank, or a PSC-containing concrete tank.

After PSC was added to the ash of the radiocontaminated paddy soil, the spatial gamma radiation dosage was slightly higher than the blank spatial gamma radiation dosage of 0.065 to 0.072 μSv/h but similar to the value prior to addition of PSC. On the other hand, the total of radiocesiums was decreased by 24% (from 29,307 Bq/kg oven-dry weight to 22,354 Bq/kg oven-dry weight). Accordingly, when the mixture thus obtained is loaded and stored in a tank, such as a steel sheet tank, a concrete tank, or a PSC-containing concrete tank, safe and secure long-term storage is possible.

When PSC was added to the ash of the mixture of PSC and radiocontaminated paddy soil, the resulting spatial gamma radiation dosage was approximately the same as the blank spatial gamma radiation dosage of 0.065 to 0.072 μSv/h, and the radiocesiums were decreased by approximately 40% (23,871 Bq/kg oven-dry weight to 14,878 Bq/kg oven-dry weight) as compared to those before the addition of PSC. Accordingly, when the mixture thus obtained is loaded and stored in a tank, such as a steel sheet tank, a concrete tank, or a PSC-containing concrete tank, safe and secure storage is possible for a long-period of time.

TABLE 6

<Effect of Addition of PSC to the Ashes of Radiocontaminated Paddy Soil Alone and Mixture thereof with PSC>

| | | Constituents | |
|---|---|---|---|
| | | Ash of radio-contaminated paddy soil alone + 20% PSC | Ash of mixture of radio-contaminated paddy soil and PSC + 20% PSC |
| Gamma radiation dosage (μSv/h) | | | |
| Before addition of PSC | Mean | 0.082 | 0.078 |
| | σ | 0.010 | 0.007 |
| After addition of PSC | Mean | 0.083 | 0.071 |
| | σ | 0.007 | 0.006 |
| Radiocesium (Bq/kg oven-dry weight) | | | |
| Before addition of PSC | $^{134}$Cs | 8,233 | 6,573 |
| | $^{137}$Cs | 21,074 | 17,299 |
| | Total | 29,307 | 23,871 |
| After addition of PSC | $^{134}$Cs | 6,287 | 4,218 |
| | $^{137}$Cs | 16,067 | 10,660 |
| | Total | 22,354 | 14,878 |

After radiocontaminated waste matter, such as radioactively contaminated rubble, soil, soil slurry, farmed mushrooms, and leaves generated by the decontamination works carried out in regions contaminated radioactively by a nuclear power plant accident; and/or radiocontaminated sludge and boiler ashes generated from treatment facilities for radiocontaminated waste water; and/or radiocontaminated mushrooms, leaves, and the like in radiocontaminated forests are mixed with PSC and then ashed, PSC is further added to the ash thus formed and then mixed therewith to form a mixture, and the mixture thus obtained is loaded and stored in steel sheet, concrete, or PSC-containing concrete tank 1 having a regular polygonal cylindrical shape with at least four corners, a circular cylindrical shape, or other suitable shape. Accordingly, the spatial gamma radiation dosage of the environment around the tank 1 is to be similar to the spatial gamma radiation dosage at a place which receives no fall-out radioactive substances from the nuclear power plant accident, and thus safe and secure retention and storage is possible. In addition, the lid 2 and the bottom base plate 4 of the tank 1 are made of the same raw material as that of the main body of the tank 1, and the lid 2 is secured by hooks 3. Since the tank 1 can be set up on the ground, it can be advantageously built from the cost and technical aspects.

Although embodiments of the present invention were described in detail in the foregoing, the present invention is not limited to the embodiments described above. Additionally, various changes in design may be performed without departing from the scope disclosed in claims of the present invention.

The invention claimed is:

1. A method for storing radiocontaminated waste matter, the method comprising the steps of:

mixing paper sludge-derived sintered carbonized porous grains with radiocontaminated waste matter;

filling said mixture of the paper sludge-derived sintered carbonized porous grains and the radiocontaminated waste matter into a container provided with a lid and a bottom base plate, the container being made of a same material as the lid and the bottom base plate.

2. The method for storing_radiocontaminated wasted matter according to claim 1, wherein the container is made of concrete, and the thickness and a density of the container are 60 to 65 mm and 2.0 to 2.4 g/cm$^3$, respectively.

3. The method for storing radiocontaminated waste matter according to claim 1, wherein the material of the container includes the paper sludge-derived sintered carbonized porous grains, and a thickness and a density of the container are 60 to 65 mm and 1.8 to 2.4 g/cm$^3$, respectively.

4. The method for storing radiocontaminated waste matter according to claim 2, wherein the material of the container includes the paper sludge-derived sintered carbonized porous grains, and the thickness and the density of the container are 60 to 65 mm and 1.8 to 2.4 g/cm$^3$, respectively.

5. The method for storing radiocontaminated waste matter according to claim 3, wherein the material of the container includes gravel, and the content of the paper sludge-derived sintered carbonized porous grains is 15% to 35% of the gravel.

6. The method for storing radiocontaminated waste matter according to claim 4, wherein the material of the container includes gravel, and the content of the paper sludge-derived sintered carbonized porous grains is 15% to 35% of the gravel.

7. The method for storing radiocontaminated waste matter according to claim 1, wherein the container is made of steel sheet, and a thickness and a density of the container are 10 to 15 mm and 7.0 to 7.8 g/cm$^3$, respectively.

8. The method for storing radiocontaminated waste matter according to claim 1, wherein said mixture is ashed at 750° C. to 950° C. for 30 to 100 minutes before being filled into the container.

9. The method for storing radiocontaminated waste matter according to claim 2, wherein said mixture is ashed at 750° C. to 950° C. for 30 to 100 minutes before being filled into the container.

10. The method for storing radiocontaminated waste matter according to claim 3, wherein the mixture is ashed at 750° C. to 950° C. for 30 to 100 minutes before being filled into the container.

11. The method for storing radiocontaminated waste matter according to claim 4, wherein said mixture is ashed at 750° C. to 950° C. for 30 to 100 minutes before being filled into the container.

12. The method for storing radiocontaminated waste matter according to claim 5, wherein said mixture is ashed at 750° C. to 950° C. for 30 to 100 minutes before being filled into the container.

13. The method for storing radiocontaminated waste matter according to claim 6, wherein said mixture is ashed at 750° C. to 950° C. for 30 to 100 minutes before being filled into the container.

14. The method for storing radiocontaminated waste matter according to claim 7, wherein said mixture is ashed at 750° C. to 950° C. for 30 to 100 minutes before being filled into the container.

15. The method for storing radiocontaminated waste matter according to claim 8, wherein an ash obtained by ashing said mixture is mixed with the paper sludge-derived sintered carbonized porous grains before being filled into the container.

16. The method for storing radiocontaminated waste matter according to claim 1, wherein a shape of the container is polygonal cylindrical with at least four corners or circular cylindrical.

17. A container for the method to shield radiocontaminated waste matter according to claim 1, wherein the paper sludge-derived sintered carbonized porous grains and the radiocontaminated waste matter are mixed together before being filled into the container.

* * * * *